United States Patent [19]

Reinhardt

[11] 4,224,026

[45] Sep. 23, 1980

[54] PROCESS FOR PREPARING FAST DYEINGS AND PRINTS ON CELLULOSE FIBER MATERIALS AND THEIR MIXTURES WITH SYNTHETIC FIBERS

[75] Inventor: Friedrich Reinhardt, Bad Soden am Taunus, Fed. Rep. of Germany

[73] Assignee: Hoechst Aktiengesellschaft, Frankfurt am Main, Fed. Rep. of Germany

[21] Appl. No.: 973,603

[22] Filed: Dec. 27, 1978

[30] Foreign Application Priority Data

Dec. 29, 1977 [DE] Fed. Rep. of Germany ..... 2758579
Mar. 15, 1978 [DE] Fed. Rep. of Germany ..... 2811167

[51] Int. Cl.[3] ..... D06P 3/82

[52] U.S. Cl. ..... 8/532; 8/456; 8/464; 8/149.3; 8/470

[58] Field of Search ..... 8/21 R, 21 C, 54.2, 8/149.3, 176, DIG. 16

[56] References Cited

U.S. PATENT DOCUMENTS

| | | | |
|---|---|---|---|
| 3,160,896 | 12/1964 | Smith | 8/DIG. 16 |
| 3,706,525 | 12/1972 | Blackwell et al. | 8/21 C |
| 3,857,676 | 12/1974 | Feess et al. | 8/21 R |
| 3,888,624 | 6/1975 | Blackwell et al. | 8/54.2 |

*Primary Examiner*—Maurice J. Welsh
*Attorney, Agent, or Firm*—Curtis, Morris & Safford

[57] ABSTRACT

Fast colorations can be obtained on cellulose materials with disperse dyestuffs containing ester groups when heat-fixation occurs in the presence of aliphatic alcohols, amines or aminoalcohols. Probably a transesterification and/or amide formation leading to significantly higher molecular weight of the dyestuffs are responsible for the good fastness properties of the colorations.

18 Claims, No Drawings

PROCESS FOR PREPARING FAST DYEINGS AND PRINTS ON CELLULOSE FIBER MATERIALS AND THEIR MIXTURES WITH SYNTHETIC FIBERS

Due to the different affinity for dyestuffs, dyeing and printing of mixed materials from cellulose and polyester fibers involves a series of problems. In the case of pigment printing the textile character of the material is affected and definite fastness properties are unsatisfactory. Working with a mixture of dyestuffs of different affinity is expensive in that the dyestuff portion without dyeing capacity has to be washed out, which furthermore requires water purification. Therefore, attempts have been made to dye mixed materials with one single class of dyestuffs. In the first place, disperse dyestuffs are used for dyeing polyester material and, therefore, efforts are made to fix this class of dyestuffs also on cellulose fibers with satisfactory fastness.

It has been proposed in German Pat. No. 1,811,796 to apply selected disperse dyesstuffs, having a certain substantivity for cellulose fibers, on a cellulose material that has been pretreated with swelling agents. The high amounts of swelling agent necessary render the process more expensive and, moreover, involve application problems.

It has now been found that disperse dyestuffs containing at least one carboxylic acid ester group yield fast dyeings and prints on cellulose fiber materials when the dyeings are fixed by steaming and/or dry heat in the presence of compounds containing a plurality of aliphatically bound hydroxy and/or amino groups. In this treatment, the ester function is probably transformed to a greater or lesser extent by transesterification or amide formation with the polyhydric alcohols or amines whereby the dyestuff molecule is enlarged.

It is, therefore, the object of the present invention to provide a process for preparing fast dyeings and prints on cellulose fiber materials, which comprises applying to the material an aqueous preparation of disperse dyestuffs containing at least one carboxylic acid ester group and fixing the dyeings by steaming and/or dry heat in the presence of a compound containing a plurality of aliphatically bound hydroxy and/or amino groups.

The transesterification or amidation can be performed in an acidic as well as in a basic medium. It proved especially advantageous to shift, during the fixation process, the pH of the medium from the weakly acidic to the alkaline range. In this manner the dyestuff can penetrate without difficulty in the acidic pH range into the polyester fiber portion when mixed materials of cellulose fibers and polyester fibers are dyed.

Suitable compounds for transesterification are especially di- and polyhydric, low molecular weight aliphatic alcohols, for example glycols, glycerol, pentaerythritol, 1,1,1-trimethylol ethane and -propane, hexane-1,3,5-triol, cyclohexane-1,4-diol, 1,4-bismethylol cyclohexane or sugar alcohols such as sorbitol and mannitol.

Polyfunctional amines that may undergo transamidation are, for example, ethylene diamine, propylene diamine, diethylene triamine, dipropylene triamine, tetramethylene diamine, hexamethylene diamine or piperazine.

There are also suitable corresponding oxalkylation products, for example triethanol amine, which may contain amine functions in addition to the alcoholic groups, as for example in ethanol amine or diethanol amine.

Preferably 1 to 200 g, more preferably 50 to 150 g of the compounds containing at least 2 hydroxy or/and amino groups are used per kilogram of printing paste or liter of dyeing liquor, especially padding liquor.

Suitable acidic catalysts are weak inorganic acids or inorganic acids of medium strength, acidic salts of inorganic acids or metal salts of inorganic acids that hydrolyze to yield an acidic medium, as well as organic mono- or polycarboxylic acids or the esters, amides or ureides thereof acting as acid donors.

As alkaline catalysts there can be used ammonium hydroxyde, alkali metal or alkaline earth metal hydroxides or ammonium, alkali metal or alkaline earth metal salts of weak or medium-strong inorganic or organic acids, for example of halogenated alkanecarboxylic acids, or organic nitrogen bases.

It is advantageous to use from 1 to 150 g, preferably 10 to 100 g of acid or acid donor or alkali or alkali donor per kilogram of printing paste or per liter of dyeing liquor, especially padding liquor.

If desired, 1 to 150 g of a swelling agent as described in German Pat. No. 1,811,796 (U.S. Pat. Nos. 3,706,525 and 3,888,624) or German Offenlegungsschrift No. 2,551,432 can be added per kilogram of printing paste or per liter of dyeing liquor.

As synthetic fibers there can be used cellulose triacetate fibers, preferably, however, polyester fibers and especially polyethylene glycol terephthalate fibers.

When the process of the invention is carried out as pad dyeing process or as printing process, the usual alkali resistant thickening agents are used for the dyestuff prepartions, preferably etherified locust bean flour derivatives.

The dyeings and prints are fixed in known manner by steaming and/or dry heat. Especially in the case of pad dyeings and prints the dyestuff is fixed by a 1 to 15 minute treatment with saturated steam or superheated steam of 160° to 190° C. and/or by a dry heat treatment, especially a hot air fixation for 20 to 90 seconds at 170° to 210° C.

The fixed dyeings are aftertreated in known manner, for example for 1 to 15 minutes at 60° to 95° C. in a bath containing anionic or non-ionic detergents.

The following examples illustrate the invention, the percentages are by weight.

EXAMPLE 1

A cotton fabric is printed with a printing paste having the following composition:

80 g of the dyestuff of the formula

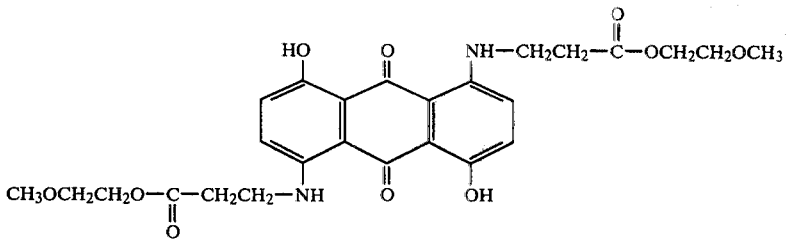

are dispersed in 10 g of 32.5% strength sodium hydroxide solution and 150 g of water. The dispersion is added while stirring to 500 g of a 5% aqueous solution of a locust bean flour carboxymethyl ether as thickening agent.

50 g of n-hexane-1,3,5-triol and 120 g of tartaric acid diethyl ester are added and the printing paste is made up to 1,000 g with 90 g of water or of the specified thickener.

The printed and dried fabric is steamed for 8 minutes at 170° C. with superheated steam, thoroughly rinsed, treated for 10 minutes at 95° C. with 1 g/l of nonyl phenol polyglycol ether containing 30 ethylene glycol units, rinsed again and dried.

A blue print having good fastness properties is obtained.

EXAMPLE 2

A spun rayon fabric is padded with a dyeing liquor of the following composition:

60 g of the dyestuff of the formula

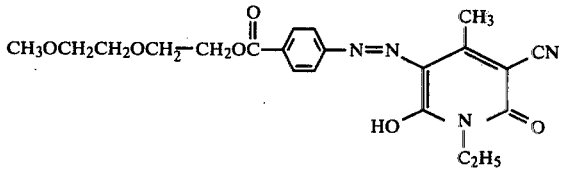

are dispersed in 10 g of 32.5% strength sodium hydroxide solution and 150 g of water. The dispersion is added while stirring to 100 g of a 5% aqueous solution of a locust bean flour carboxymethyl ether.

50 g of glycerol and 80 g of sodium monochloroacetate and added to the mixture and the liquor is made up to 1,000 g with 550 g of water.

The padded and dried fabric is steamed for 5 minutes at 100° C. with saturated steam, rinsed, soaped for 10 minutes at 95° C., rinsed again and dried.

A yellow dyeing having good fastness properties is obtained.

EXAMPLE 3

A mixed fabric of 50% of polyethylene glycol terephthalate fibers and 50% of regenerated cellulose fibers is printed with a printing paste having the following composition:

200 g of a 10% preparation of the dyestuff of the formula

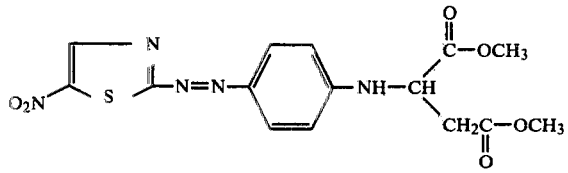

are dispersed in 100 g of water and added while stirring to 500 g of a 5% aqueous solution of an etherified guar flour as thickener.

120 g of pentaerythritol and 10 g of sodium formate are added to the printing paste and the whole is made up to 1,000 g by adding 70 g of water or the specified thickener.

The printed and dried fabric is heated on the hot air tenter frame for 60 seconds to 200° C., thoroughly rinsed and soaped for 10 minutes at 95° C.

A bordeaux print having good fastness properties is obtained.

EXAMPLE 4

A knitted cotton fabric is printed with a printing paste having the following composition:

70 g of the dyestuff of the formula

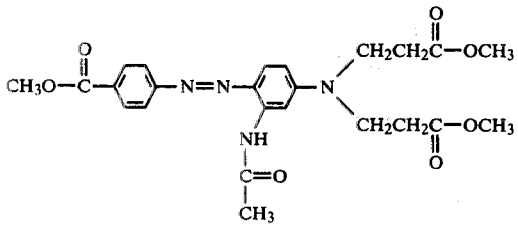

are dispersed in 5 g of 32.5% sodium hydroxide solution and 150 g of water. The dispersion is introduced into 500 g of a 5% aqueous solution of a locust bean flour carboxymethyl ether as thickener.

120 g of n-hexane-1,3,5-triol are then added to the print paste and the whole is made up to 1,000 g with 155 g of water or of the specified thickener.

The printed knitted fabric is steamed for 5 minutes at 100° C. with saturated steam and after-treated in usual manner.

An orange print having good fastness properties is obtained.

EXAMPLE 5

A fabric consisting of 65% of polyethylene glycol terephthalate fibers and 35% of cotton fibers is printed with a printing paste having the following composition:

200 g of a 10% liquid preparation of the dyestuff of the formula

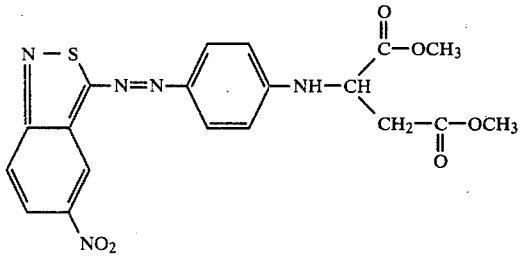

are dispersed in 100 g of water. The dispersion is introduced while stirring into 500 g of a 5% aqueous solution of a locust bean flour carboxylmethyl ether as thickener.

150 g of n-hexane-1,3,5-triol and 10 g of sodium formate are added to the mixture and the whole is made up to 1,000 g with 40 g of water or of the specified thickener.

The printed and dried fabric is steamed for 6 minutes at 180° C in superheated steam and aftertreated as described in Example 1.

A red-violet print having good fastness properties is obtained.

EXAMPLE 6

A fabric as used in Example 5 is printed with a printing paste having the composition defined in Example 5 with the exception that the dyestuff of that example is replaced by 80 g of the dyestuff of the formula

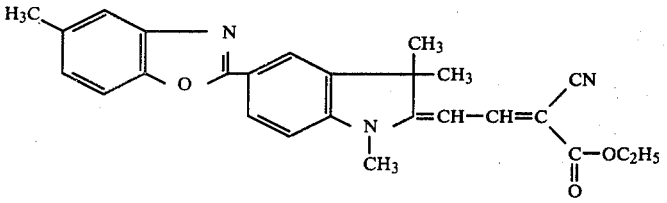

The print is fixed and the fabric aftertreated as described in Example 5.

A yellow print having good fastness properties is obtained.

EXAMPLE 7

A fabric as used in Example 5 is printed with a printing paste having the composition defined in Example 5 with the exception that the dyestuff of that example is replaced by 200 g of a 10% liquid preparation of the dyestuff of the formula

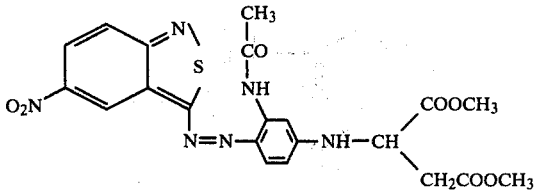

The print is fixed and the fabric aftertreated as described in Example 5.

A greenish blue print having good fastness properties is obtained.

EXAMPLE 8

A cotton fabric is printed with a printing paste having the following composition:

200 g of a 10% liquid preparation of the dyestuff of the formula

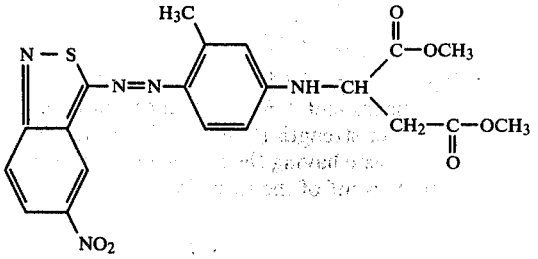

are dispersed in 100 g of water. The dispersion is worked into 500 g of a 5% aqueous solution of a wheat starch carboxymethyl ether as thickener.

50 g of piperidine and 50 g of diethylene triamine are added to the mixture and the whole is made up to 1,000 g with 100 g of water or of the specified thickener.

The printed fabric is heated for 60 seconds to 200° C. and washed as described in Example 1.

A violet print having good fastness properties is obtained.

EXAMPLE 9

A spun rayon fabric is padded with a padding liquor having the following composition:

60 g of the dyestuff of the formula

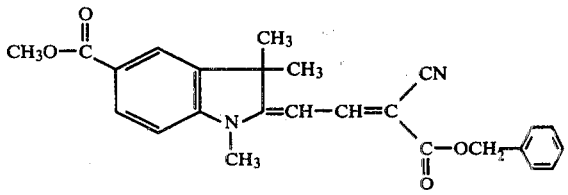

are dispersed in 100 g of water. The dispersion is mixed with 100 g of a 5% aqueous solution of a locust bean flour methyl ether. To the dyeing liquor are further added 120 g of triethanol amine. The whole is made up to 1 liter with 620 g of water.

The padded and dried fabric is steamed for 5 minutes with saturated steam, washed as usual and dried.

A yellow dyeing having good fastness properties is obtained.

EXAMPLE 10

A fabric consisting of 65% of polycyclohexanediol terephthalate fibers and 35% of regenerated cellulose fibers of high wet strength ("Modal" fibers) is printed with a printing paste having the following composition:

70 g of the dyestuff of the formula

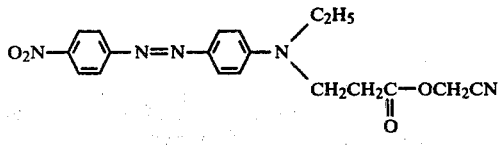

are dispersed in 150 g of water. The dispersion is introduced while stirring into 500 g of a 5% aqueous solution of a locust bean flour carboxymethyl ether as thickener.

150 g of n-hexane-1,3,5-triol and 20 g of sodium monochloroacetate are added and the whole is made up to 1,000 g with 110 g of water or of the specified thickener.

The printed and dried fabric is steamed for 5 minutes at 100° C. with saturated steam, subjected to a thermosol process for 60 seconds at 200° C. and aftertreated as described in Example 1.

A scarlet print having satisfactory fastness properties is obtained.

EXAMPLE 11

A fabric as used in Example 5 is printed with a printing paste as defined in that example with the exception that as coloring component 80 g of the dyestuff of the formula

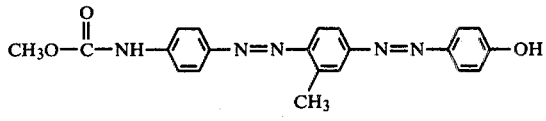

are used.

The print on the dried fabric is fixed and the fabric aftertreated under the conditions of Example 10.

An orange print having good fastness properties is obtained.

EXAMPLE 12

A fabric as used in Example 5 is printed with a printing paste having the following composition:

80 g of the dyestuff of the formula

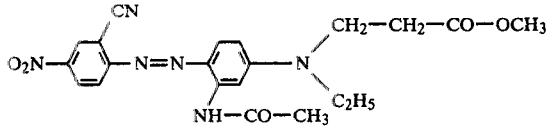

are dispersed in 2 g of 32.5% sodium hydroxide solution and 150 g of water. The dispersion is introduced while stirring into 500 g of a 5% aqueous solution of a locust bean flour carboxymethyl ether as thickener.

60 g of n-hexane-1,3,5-triol and 60 g of a polyethylene glycol of a molecular weight of 600 are added to the printing paste and the whole is made up to 1,000 g with 148 g of water or of the specified thickener.

The printed and dried fabric is steamed for 8 minutes at 180° C. with superheated steam and then washed as described in Example 1.

A red violet print is obtained having satisfactory fastness properties.

What is claimed is:

1. A process for producing fast colorations on a cellulose material which comprises contacting said materials with an aqueous preparation of a disperse dyestuff containing one or more esterified carboxylic acid groups and fixing the coloration by steaming and/or dry heat in the presence of a compound containing more than one hydroxy and/or amino groups linked to aliphatic carbon atoms to cause said compound to transesterify and/or transamidate at least partially the ester group or groups of said dyestuff.

2. A process as claimed in claim 1, wherein the coloration is effected by printing or padding.

3. A process as claimed in claim 1, wherein the cellulose material contains synthetic fibers.

4. A process as claimed in claim 3, wherein the synthetic fibers are polyester fibers.

5. A process as claimed in claim 3, wherein the cellulose material contains up to 70% by weight of synthetic fibers.

6. A process as claimed in claim 1, wherein the compound containing more than one hydroxy and/or amino groups is a low-molecular polyfunctional aliphatic alcohol, amine or aminoalcohol.

7. A process as claimed in claim 6, wherein said compound is a low-molecular glycol or diglycol, glycerol, pentaerythrit, 1,1,1-trimethol-ethane, 1,1,1-trimethylolpropane, hexane-1,3,5-triol, cyclohexane-1,4-diol, 1,4-bismethylol-cyclohexane, a mono-saccharide alcohol, a low-molecular alkylene diamine, a low-molecular dialkylene triamine, piperazine, a low-molecular alkanolamine, a low-molecular di-alkanol-amine or a low-molecular tri-alkanol-amine.

8. A process as claimed in claim 6, wherein the aqueous preparation contains per kilogram or liter 1 to 200 g of said compound.

9. A process as claimed in claim 6, wherein the aqueous preparation contains per kilogram or liter 50 to 150 g of said compound.

10. A process as claimed in claim 1, wherein the fixation occurs in the presence of an acidic or basic catalyst.

11. A process as claimed in claim 1, wherein the dyestuff preparation contains per kilogram or liter 1 to 150 g of an acid, a base or a compound liberating an acid or a base under the fixation conditions.

12. A process as claimed in claim 11, wherein the preparation contains per kilogram or liter 10 to 100 g of acid or base or precursor thereof.

13. A process as claimed in claim 1, wherein fixation is performed by steaming with saturated or superheated steam.

14. A process as claimed in claim 1, wherein fixation is performed by a treatment with hot air.

15. A process as claimed in claim 1, wherein the dyestuff contains 1 to 3 ester groups.

16. A process as claimed in claim 1, wherein the alcohol component of said ester group or groups is a low-molecular alkanol, low-molecular cyano-alkanol or a low-molecular mono-alkyl ether of a low-molecular mono- or di-alkylene glycol.

17. A process as claimed in claim 1, wherein the aqueous preparation contains per kilogram or liter 10 to 100 g of dyestuff.

18. A process as claimed in claim 1, wherein the aqueous preparation contains 20 to 80 g of dyestuff.

* * * * *